US008327858B2

(12) United States Patent
Neuner et al.

(10) Patent No.: US 8,327,858 B2
(45) Date of Patent: Dec. 11, 2012

(54) VIBRATING MASCARA APPLICATOR

(75) Inventors: Charles P. Neuner, Amityville, NY (US); George H. Kress, Fanwood, NJ (US)

(73) Assignee: ELC Management LLC, New York, NY (US)

( * ) Notice: Subject to any disclaimer, the term of this patent is extended or adjusted under 35 U.S.C. 154(b) by 352 days.

(21) Appl. No.: 12/128,170

(22) Filed: May 28, 2008

(65) Prior Publication Data

US 2008/0276955 A1 Nov. 13, 2008

Related U.S. Application Data

(63) Continuation-in-part of application No. 11/154,623, filed on Jun. 16, 2005, now Pat. No. 7,465,114.

(60) Provisional application No. 60/600,452, filed on Aug. 11, 2004.

(51) Int. Cl.

| | |
|---|---|
| ***A45D 40/26*** | (2006.01) |
| ***A46B 11/00*** | (2006.01) |
| ***A46B 13/00*** | (2006.01) |
| ***A47L 11/00*** | (2006.01) |

(52) U.S. Cl. ..... 132/218; 401/129; 401/126; 15/22.1

(58) Field of Classification Search ..... 132/216, 132/217, 218, 320, 318, 119.1, 297, 313; 401/126, 129, 195; 15/22.1

See application file for complete search history.

(56) References Cited

U.S. PATENT DOCUMENTS

| | | | |
|---|---|---|---|
| 3,030,647 | A | 4/1962 | Peyron |
| 3,033,197 | A | 5/1962 | Barckley |
| 3,383,157 | A | 5/1968 | Goldhirsch |
| 3,384,095 | A | 5/1968 | Shih |
| 3,661,018 | A | 5/1972 | Keefer et al. |
| 3,794,050 | A | 2/1974 | Gallanis et al. |
| 3,892,997 | A | 7/1975 | Thorington et al. |
| 3,998,235 | A | 12/1976 | Kingsford |
| 4,011,616 | A | 3/1977 | Kennedy |
| 4,056,111 | A | 11/1977 | Mantelet |
| 4,236,314 | A | 12/1980 | Schmidt et al. |
| 4,397,326 | A | 8/1983 | Formica |
| 4,545,393 | A | 10/1985 | Gueret et al. |
| 4,586,520 | A | 5/1986 | Brittain |
| 4,632,136 | A | 12/1986 | Kingsford |
| 4,733,425 | A | 3/1988 | Hartel et al. |
| 4,861,179 | A | 8/1989 | Schrepf et al. |

(Continued)

FOREIGN PATENT DOCUMENTS

| | | |
|---|---|---|
| CN | 1375273 | 10/2002 |

(Continued)

OTHER PUBLICATIONS

PCT International Search Report; International Application No. PCT/US2009/045210; Completion Date: Jan. 13, 2010; Date of Mailing: Jan. 14, 2010. (Related Case: U.S. Appl. No. 12/128,170).

(Continued)

*Primary Examiner* — Vanitha Elgart

(74) *Attorney, Agent, or Firm* — Peter Giancana

(57) ABSTRACT

The present invention is an improved vibrating mascara applicator. The head is caused to vibrate in a controlled manner through electromechanical urging. The source of the vibration is substantially close to the applicator head. The improved vibrating applicator improves applicator performance, mascara performance, consumer experience and energy efficiency.

16 Claims, 2 Drawing Sheets

U.S. PATENT DOCUMENTS

| | | | | |
|---|---|---|---|---|
| 4,887,622 | A | 12/1989 | Gueret | |
| 4,914,988 | A | 4/1990 | Chang | |
| 4,993,440 | A | 2/1991 | Gueret | |
| 5,094,254 | A | 3/1992 | Krueckel et al. | |
| 5,107,870 | A | 4/1992 | Beck et al. | |
| 5,137,038 | A | 8/1992 | Kingsford | |
| 5,180,241 | A * | 1/1993 | Gueret | 401/122 |
| 5,187,827 | A | 2/1993 | Wei | |
| 5,238,011 | A | 8/1993 | Gueret | |
| 5,247,218 | A * | 9/1993 | Sven | 310/81 |
| 5,299,354 | A | 4/1994 | Metcalf et al. | |
| 5,341,534 | A | 8/1994 | Serbinski et al. | |
| 5,345,644 | A | 9/1994 | Gueret | |
| 5,357,987 | A | 10/1994 | Schrepf | |
| 5,448,792 | A * | 9/1995 | Wiedemann et al. | 15/22.1 |
| 5,476,384 | A | 12/1995 | Giuliani et al. | |
| 5,482,059 | A | 1/1996 | Miraglia | |
| 5,492,136 | A | 2/1996 | Edmonds | |
| 5,567,072 | A | 10/1996 | Dunleavy et al. | |
| 5,595,198 | A | 1/1997 | Kemmerer | |
| 5,761,760 | A | 6/1998 | Dumler et al. | |
| 5,775,344 | A | 7/1998 | Clay | |
| 5,816,728 | A | 10/1998 | Nardolillo et al. | |
| 5,860,432 | A | 1/1999 | Gueret | |
| 5,937,871 | A | 8/1999 | Clay | |
| 5,967,105 | A | 10/1999 | Freeland | |
| 6,009,884 | A | 1/2000 | Suh | |
| 6,139,553 | A | 10/2000 | Dotan | |
| 6,142,692 | A | 11/2000 | Garcia | |
| 6,145,514 | A | 11/2000 | Clay | |
| 6,178,579 | B1 | 1/2001 | Blaustein et al. | |
| 6,214,329 | B1 | 4/2001 | Brieva et al. | |
| 6,237,609 | B1 | 5/2001 | Vasas | |
| 6,345,626 | B1 | 2/2002 | Bouix | |
| 6,371,131 | B1 | 4/2002 | Finocchiaro et al. | |
| 6,421,865 | B1 * | 7/2002 | McDougall | 15/22.1 |
| 6,450,178 | B1 | 9/2002 | Clay | |
| 6,481,104 | B1 | 11/2002 | Parker et al. | |
| 6,565,276 | B1 | 5/2003 | Diaz | |
| 6,691,716 | B2 | 2/2004 | Neuner et al. | |
| 6,716,420 | B2 | 4/2004 | Feng et al. | |
| 6,802,097 | B2 * | 10/2004 | Hafliger et al. | 15/22.1 |
| 6,811,340 | B2 | 11/2004 | Petit | |
| 6,869,594 | B2 | 3/2005 | Ferrari | |
| 6,920,659 | B2 * | 7/2005 | Cacka et al. | 15/22.1 |
| 7,078,026 | B2 | 7/2006 | Ferrari et al. | |
| 7,114,506 | B2 * | 10/2006 | Junkins | 132/322 |
| 7,165,906 | B2 | 1/2007 | Dieudonat et al. | |
| 7,465,114 | B2 | 12/2008 | Kress et al. | |
| 7,886,393 | B2 * | 2/2011 | Sorrentino | 15/22.1 |
| 8,118,507 | B2 * | 2/2012 | Kress et al. | 401/129 |
| 2002/0034480 | A1 | 3/2002 | Grimm et al. | |
| 2002/0116774 | A1 | 8/2002 | Forrest | |
| 2002/0168214 | A1 | 11/2002 | Carullo et al. | |
| 2003/0089379 | A1 * | 5/2003 | Gueret | 132/218 |
| 2004/0134507 | A1 * | 7/2004 | Gueret | 132/218 |
| 2004/0234323 | A1 | 11/2004 | Albisetti et al. | |
| 2004/0240926 | A1 | 12/2004 | Gueret | |
| 2006/0032053 | A1 | 2/2006 | Saker et al. | |
| 2006/0032054 | A1 | 2/2006 | Simms et al. | |
| 2006/0032055 | A1 | 2/2006 | Simms et al. | |
| 2006/0032512 | A1 | 2/2006 | Kress et al. | |
| 2006/0037197 | A1 | 2/2006 | Hawes et al. | |
| 2006/0272666 | A1 | 12/2006 | Wyatt et al. | |
| 2006/0272667 | A1 | 12/2006 | Wyatt et al. | |
| 2006/0272668 | A1 | 12/2006 | Wyatt et al. | |
| 2007/0289602 | A1 * | 12/2007 | Simmons | 132/218 |
| 2008/0011316 | A1 | 1/2008 | Malvar et al. | |
| 2008/0062678 | A1 | 3/2008 | Levy et al. | |
| 2008/0087296 | A1 | 4/2008 | Gueret | |
| 2009/0007928 | A1 * | 1/2009 | Kress et al. | 132/218 |
| 2009/0007929 | A1 * | 1/2009 | Kress | 132/218 |
| 2009/0071501 | A1 * | 3/2009 | Gueret | 132/218 |
| 2010/0239352 | A1 * | 9/2010 | Huang | 401/121 |
| 2011/0061186 | A1 * | 3/2011 | Questiaux et al. | 15/22.1 |

FOREIGN PATENT DOCUMENTS

| | | |
|---|---|---|
| DE | 8603383 | 9/1986 |
| DE | 19950665 | 5/2000 |
| DE | 202 10 482 | 9/2002 |
| EP | 0 289 726 | 11/1988 |
| EP | 0 511 842 | 11/1992 |
| EP | 1563760 | 8/2005 |
| FR | 2848790 | 6/2004 |
| GB | 846639 | 8/1960 |
| JP | 8289815 | 11/1996 |
| JP | 2004-187651 | 7/2004 |
| JP | 2005095531 | 4/2005 |
| TW | 315529 | 7/2007 |
| WO | WO02/072042 | 9/2002 |
| WO | WO2004/073936 | 9/2004 |
| WO | WO2004/073938 | 9/2004 |
| WO | WO2004/073940 | 9/2004 |
| WO | WO2004/073941 | 9/2004 |
| WO | WO2005/046508 | 5/2005 |
| WO | WO2006-020577 | 2/2006 |
| WO | WO2006/090343 | 8/2006 |
| WO | WO 2007/084972 | 7/2007 |

OTHER PUBLICATIONS

PCT Written Opinion of the International Searching Authority, or the Declaration; International Application No. PCT/US2009/045210; Completion Date: Jan. 13, 2010; Mailing Date: Jan. 14, 2010. (Related Case: U.S. Appl. No. 12/128,170).

PCT International Search Report; International Application No. PCT/US2009/049892); Completion Date: Feb. 18, 2010; Date of Mailing. Feb. 19, 2010. (Related Case: U.S. Appl. No. 12/171,723).

PCT Written Opinion of the International Searching Authority, or the Declaration; International Application No. PCT/US2009/049892; Completion Date: Feb. 19, 2010; Mailing Date: Feb. 18, 2010. Related Case: U.S. Appl. No. 12/171,723).

Judy Rice; "Automated-Motion Masara"; Packaging World; p. 98; Sep. 2006.

PCT International Search Report: International Application No. PCT/US05/28156; Completion Date: Mar. 27, 2008; Date of Mailing: Jun. 12, 2008.

PCT Written Opinion of the International Searching Authority, or the Declaration; International Application No. PCT/US05/28156; Completion Date: Mar. 27, 2008; Mailing Date: Jun. 12, 2008.

Supplementary European Search Report; EP08022470.2; Completion Date: Mar. 11, 2009; Date of Mailing: Mar. 18, 2009. (Divisional Applic.).

Supplementary European Search Report; EP05784145.4; Completion Date: Mar. 10, 2009; Date of Mailing: Mar. 18, 2009.

Ridson/Elizabeth Arden Advertisment, http://crownrisdon.com/products/eyecare.htm, Accessed Feb. 18, 2005.

* cited by examiner

VIBRATING MASCARA APPLICATOR

The present application is a CIP of U.S. Ser. No. 11/154,623, filed Jun. 16, 2005 now U.S. Pat. No. 7,465,114, which claims priority under 35 U.S.C. 119e of U.S. provisional application 60/600,452 filed Aug. 11, 2004.

INTRODUCTION

The present application incorporates by reference, in its entirety, the contents of US20060032512 (U.S. Ser. No. 11/154,623; Kress et al.) and U.S. 60/600,452 (Kress).

The present invention pertains to improved vibrating mascara applicators. Specifically, the present invention relates to vibrating mascara applicators that comprise a source of vibration that is located within a mascara container, when the applicator is inserted into the container. The frequency and amplitude of the vibrating applicator are sufficient to significantly alter the viscosity of a mascara, in a controlled manner, thus allowing the mascara to be manipulated at the time of use, for improved results. The location of the source of vibration leads to benefits in the field of vibrating mascara applicators, particularly in their performance and manufacture.

BACKGROUND

The most common mascara applicator is the mascara brush. A typical mascara brush comprises a core, bristles, a stem and a handle. The core is typically a pair of parallel wire segments formed from a single metallic wire that has been folded into a u-shape. Bristles, usually comprised of strands of nylon, are disposed between a portion of a length of the wire segments. The wire segments, with the bristles disposed therebetween, are twisted or rotated about each other to form a semi-rigid helical core, also known as a twisted wire core. The twisted core holds the bristles substantially at their midpoints so as to firmly clamp them. In this state, the bristles, which are secured in the twisted wire core, extend radially from the core in a helical or spiral manner. Collectively, the radially extending bristles form a bristle portion or bristle head. The imaginary surface of the bristle head, comprising all of the bristle tips, is known as the bristle envelope. Many variations of this brush are known in the art. Although the results of mascara application and customer satisfaction depend on the combination of product and brush, it is useful to separately discuss the performance of each.

Mascara Brushes: Characteristics and Performance

An ideal mascara brush may be thought of as one that performs certain functions. These include taking up, in one step, enough product from the mascara reservoir to coat all the lashes of one eye, without having to re-insert the brush into the reservoir. The act of repeatedly reinserting the brush into the reservoir has the effect of incorporating air into the mascara in the reservoir, which causes the mascara to dry out and become unusable faster than it otherwise would. Further, the ideal brush must transfer to the lash enough product to coat the entire lash. That is, having withdrawn from the reservoir an optimal amount of product, the ideal brush must now be able to transfer that product to the lashes. To some degree, the ability of the applicator to take up product from the reservoir and the ability to give off that product to the eyelashes work against each other. In the first instance it is desirable for mascara to stick to the brush so that it can be removed from the reservoir. In the second instance it is desirable for the mascara to unstick from the brush so that it may cling to the lashes. Having deposited the product on the lash, the ideal brush evenly distributes the product over all the lashes. Further, the ideal brush smoothes out any clumps of product which may have been drawn from the reservoir and placed on the lashes. The ideal brush is able to separate and comb out the lashes to give the lashes a clean, well groomed, finished appearance. The ideal brush can be used effectively to touch up or doctor the lashes as needed. Also, a brush that evacuates substantially all of the mascara product from the reservoir is ideal. To date, a single brush that performs all of these functions optimally is believed not to exist. This is because different bristle types and configurations are better or worse at one or more functions. Therefore, a typical mascara brush represents a trade-off between maximizing some brush functions at the expense of others. The finally selected brush depends on the nature of the mascara product with which it is to be used. For example, a mascara formulated to give volume to the lashes should ideally be sold with a brush suitable for that purpose.

The current state of mascara brush art is such that some parameters known to affect various brush functions have been identified. Generally, the values of these parameters cannot be adjusted to produce an ideal brush, that is, a brush that performs all the desired functions satisfactorily. Because of this trade-off situation, there exist a great number of variations of the typical mascara brush. Some brushes seek to maximize some functions at the expense of others, while other brushes attempt to split the difference, so to speak, by performing many functions somewhat satisfactorily. Arriving at these variations is frequently no more than selecting appropriate values for the various known parameters. A review of those parameters that are recognized by a person of ordinary skill in the art to be results-effective, is in order.

The shape of the wire core. While a straight core may be the most common in the cosmetics marketplace, bent wire cores are also known. For example, a core in the shape of an arc that attempts to match the shape of the eyelid are known (U.S. Pat. No. 5,137,038, U.S. Pat. No. 5,860,432 and U.S. Pat. No. 6,237,609). This shape, it is supposed, may be more efficient at coating the lashes. In U.S. Pat. No. 5,761,760 the wire core is bent to form a closed loop. The purpose of the loop is to provide a reservoir for retaining and transferring mascara or other pasty product from the mascara container to the eyelashes. Because this brush applies a relatively large dose of mascara, it is suitable for increasing length and volume of the lashes. It may be less suitable for combing, declumping and separating the lashes.

Stiff verses flexible bristles. It is generally recognized in the art, that stiffer bristles are better than more flexible bristles when it comes to loading the brush with mascara from the reservoir. Stiffer bristles are thought to retrieve more product from the reservoir than do more flexible bristles. As the brush is withdrawn from the reservoir it passes through a wiper one function of which is to spread the product as evenly as possible over the surfaces of the bristles to provide a neater brush. In this way, portions of the brush with relatively high concentrations of product may be thinned out and some portions with relatively little product may be loaded. Generally, bristles that are too flexible will become matted down upon passing through the wiper and thereafter may remain stuck together because mascara is typically quite tacky. Having been removed from the reservoir, the loaded brush is made to contact the eyelashes. At this point, it is generally understood that a brush with softer, more flexible bristles in a dense array is better for transferring the mascara to the eyelashes by affecting as much transfer as possible. Once the eyelashes are loaded, however, it is generally understood that an applicator brush having stiffer bristles and a relatively open bristle envelope or sparse array (so as to be more comb-like) is needed to declump the product and separate the lashes. Given this situation, various attempts have been made to provide a mascara brush that combines the benefits of both stiff and flexible bristles. For example, a brush that is said to provide good application and combing characteristics is shown in U.S. Pat. No. 4,861,179. Disclosed is a brush having a combination of conventional soft bristles and conventional stiff bristles. Another example of a brush said to provide good application and combing characteristics is shown in U.S. Pat. No. 5,238,011 which discloses bristles made of a soft material having a shore hardness of 20 A to 40 D (a conventional bristle typically has a durometer of over 85 D), and a large diameter in a range of 3.9 to 13.8 mil (10 to 35 hundredths of a millimeter), which is at least 1.5 mil (~4 hundredths of a millimeter) wider than a typical soft polyamide bristle. In this patent, the diameter is said to be sufficiently large to prevent too high a degree of suppleness. The resulting brush is said to have the same degree of suppleness or softness as a conventionally softer brush. Accordingly, the bristles are equivalent in stiffness to conventional bristles.

While these references may disclose brushes suitable for the application and combing of conventional mascara, currently preferred mascaras have significantly higher resting viscosity (two million CPS and above). These higher viscosity mascaras tend to collapse bristles of conventional stiffness, thus rendering a brush having bristles of conventional stiffness ineffective for purposes of application or combing. Accordingly, some of the forgoing brushes would not be suitable for use with such higher viscosity mascaras. Furthermore, these brushes do not offer the user the opportunity to compensate, at will, for one or the other shortcoming (i.e. bristles too soft or too stiff). Once these brushes leave the factory, they are what they are and cannot be altered by the user.

Bristle length and density. As a general rule, longer and more densely spaced bristles retrieve more product from the reservoir and deposit a thicker coating of mascara on the lashes than shorter, less densely spaced bristles. This is simply because in the former case there is more surface area on which to accumulate mascara. However, one problem with densely spaced bristles that carry a large quantity of mascara is that the lashes may not be able to penetrate the space between the bristles. This is simply because the lashes are so flexible. Also, because densely spaced bristles carry a lot of product from the reservoir while tending not to separate the lashes, there is a tendency for the lashes to clump together during application. With such a brush, it is not easy to obtain an even coat on the lashes. A lot of brushing, effort, skill and patience on the part of the user is required. In contrast, a brush with less densely spaced bristles may penetrate the lashes easily, but delivers less product, perhaps an insufficient coating to the lashes. To overcome this, the procedure must be repeated multiple times for each lash. It is generally understood in the art, that the more times the making up procedure is repeated, the more chance there is to mess up the entire application of mascara. The longer it takes to perform the application, the more complicated it becomes. If the product already applied to the lashes is setting up and drying out while new mascara is still being applied over it, an even, clean appearance may be very difficult to achieve. It may become necessary to clean the eyelashes and start again. Mascara application is known to be a bit of a skill and a bit of an art, wherein less is sometimes more.

U.S. Pat. No. 4,887,622 discloses a low density mascara brush, the bristles of which are spaced from 10 to 40 bristles per turn of the twisted wire core. As discussed in the '622 patent, then-conventional brushes had about 50 to 60 bristles per turn with the per-turn pitch being about 2 mm and the bristle diameter being about 0.08 mm maximum. It is alleged that 50-60 bristles per turn is sufficient to take up enough mascara to coat the lashes, but that brushes of this bristle density do not distribute the product very well, resulting in blobs of product and wasted time. The alleged improvement consists of reducing the bristles per turn to 10-40 while using bristles of a larger diameter (0.10 to 0.25 mm). Though there are fewer bristles to carry product, more product may carried by each bristle. The lower density permits the bristles to penetrate the lashes and provide an even coat of product.

Mixing bristle types. U.S. Pat. No. 4,586,520 disclose a mascara applicator whose brush contains alternating rows of long and short bristles. It is alleged that this arrangement of alternating rows of long and short bristles allows for easier application of mascara while simultaneously combing and separating the eyelashes. U.S. Pat. No. 5,345,644 discloses a mascara brush having two different types of bristles intermingled along the axis of the brush. One type is a smaller diameter (0.06-0.13 mm), higher melting point thermoplastic bristle, the other is a larger diameter (0.13-0.30 mm), lower melting point thermoplastic bristle. It is alleged that strong, distinct make-up effects are achieved with this type of brush.

Sectioning bristle types. U.S. Pat. No. 5,357,987 and EP 0511842 disclose mascara brushes having a bristle array with a discontinuous profile. There is a tip portion having one overall size and shape and a proximal portion having a second size and shape. The main reason for this is to provide a single brush in sections, each section of which is better than the other section at performing some application tasks.

U.S. Pat. No. 5,482,059 combines sectioning and mixed bristle types within one section. This patent discloses a mascara brush having three sections and three types of bristles. The brush portion has a larger diameter middle section comprised of a combination of soft and stiff bristles in random configuration, and two end sections comprised of hollow filaments which preferably become progressively shorter towards the ends of the brush portion. The end sections exhibit less bristle density than the middle section. This improved brush configuration allows for optimal one-stroke mascara application.

Shape of the envelope. The most conventional envelope shape is the tapered spiral or helical array of bristles. One variation on this theme is U.S. Pat. No. 5,595,198 in which a helical groove is present along the length of the bristle array due to the use of specifically positioned, shorter bristles. The groove is for carrying larger quantities of product than would otherwise be possible. A great many envelopes shapes have been introduced into the art, each purporting to be an improvement on one or more aspects of mascara application.

Bristle shape. U.S. Pat. No. 4,993,440 discloses the use of bristles having capillary channels along their length. U.S. Pat. No. 5,567,072 discloses bristles with a slotted cross sectional configuration. U.S. Pat. No. 5,595,198 discloses bristles with an L-shaped cross section. Tubular bristles are disclosed in U.S. Pat. No. 4,733,425.

Other applicator features. Mascara applicators that are said to have performance enhancing features apart from the applicator head, are known. Ergonomic handles and comfort grips are known. US patent publication 2002-0168214 discloses a mascara handle grip made from one or more deformable elastomers and having a dual-tapered portion such that two tapered sections meet at a narrowest point along the dual-tapered portion, and wherein the cross section of one or both tapered sections is elliptical. The use of this or any other deformable grip on a vibrating mascara applicator system is unknown to the applicant.

Non conventional mascara applicators. In the quest for the ideal mascara applicator some have avoided the issue of stiff verses flexible bristles by not using bristles. U.S. Pat. No. 3,892,997 describes an applicator comprising a central shaft (or core) along the length of which rigid triangular plates outwardly project, many such plates being parallel to each other. The regularly spaced plates are reportedly suitable for loading, transferring, coating and separating. U.S. Pat. No. 4,545,393 described a bellows capable of being lengthened or shortened by the user as required. The stacked "teeth" of the bellows provide surfaces for holding mascara and the spacing between the teeth allows the eyelashes to be coated and separated. U.S. Pat. No. 5,094,254 describes a central core with a ribbed profile. The individual ribs provide surfaces for holding mascara and the spacing between the ribs allows the eyelashes to be coated and separated. U.S. Pat. No. 5,816,728 describes a beaded mascara applicator, that is a mascara applicator having one or more beads disposed on a central axle extending longitudinally from an elongated rod and handle. A first preferred embodiment comprises a single cylindrical bead molded from plastic and having a series of longitudinally spaced grooves along the length of the bead. A second preferred embodiment comprises a plurality of about 5 to 7 beads disposed on a metal axle and retained by means of a flat-headed pin. The beads are capable of individually or collectively rotating about the axle to create optimal mascara application and lash separation. U.S. Pat. No. 6,345,626 and U.S. Pat. No. 6,691,716 disclose a mascara applicator having an array of independent discs which compress during withdrawal from a container so that excess product can be removed from the applicator by a wiper. After passage through the wiper, the discs return to their expanded position by the action of a spring. The compressing of the discs during withdrawal allows a controlled amount of product to remain on the applicator for application by the consumer, and the returning of the discs to their expanded position by the spring causes the discs to assume a configuration which allows the applicator to effectively comb and separate the eyelashes.

As can be seen from the foregoing brief survey of the mascara applicator field, many innovations and proposals have been put forward. However, prior to the filing of a first U.S. application (U.S. 60/600,452; Kress; Aug. 11, 2004), nothing in the prior art anticipated or suggested a vibrating mascara applicator capable of substantially altering the viscosity of a mascara in a controlled fashion, measurably altering the flow characteristics of a mascara product at the time of application, nor the benefits of such.

Since the filing of the '452 application (Kress), a number of patent applications have been filed for mascara applicators that vibrate, oscillate, rotate, translate or some combination of movements.

WO2006/090343 (L'Oreal), filed Feb. 24, 2006, concerns an applicator for applying a makeup composition, the applicator may be a mascara applicator comprising an applicator element and a vibration source causing the applicator element to vibrate. The applicator is configured to be fastened onto a receptacle that contains a composition to be applied. The source of applicator movement is in the handle.

US2006/0272666, US2006/0272667 and US2006/0272668 (Wyatt, et al), filed Jun. 2, 2005 disclose an apparatus for applying a cosmetic, such as mascara to eyelashes. The apparatus includes a handle, a stem, and an applicator head coupled to the stem. An actuator moves the applicator head in one or more of a vibrational motion, rotational motion, circular motion, axial motion (parallel to the stem) or oscillating rotational motion. The source of applicator movement is in the handle.

U.S. Pat. No. 7,165,906, filed Apr. 10, 2006 discloses a mascara applicator comprising a head for manually gripping the applicator (that is, a handle), an axial stem and an application means. The applicator is characterized in that it comprises a means of rotation of the axial stem. The means of rotation comprises a fixed part attached to said head (handle), and a rotating part attached in rotation to said axial stem, and a manual means of activation and/or deactivation of the means of rotation. The source of applicator movement is in the handle.

Taiwan patent M315529 (HUANG, Guo Hua), filed Jan. 3, 2007, entitled Vibrating Cosmetic Case discloses a wand type applicator, attached to a handle and having a source of applicator movement in the handle.

US2008/0011316 (Malvar et al.), filed Jul. 6, 2007, discloses a mascara applicator that comprises a stem bearing an applicator head, the stem being received in and guided by the handle so as to be longitudinally reciprocal relative thereto. The applicator further comprises an actuating mechanism carried by the handle for moving the stem longitudinally back and forth relative to the handle. Thus, the source of applicator movement is in the handle.

US2008/0062678 (Levy et al.), filed Sep. 18, 2007, discloses a vibrating makeup device, which, in some embodiments may include a mascara applicator. The source of applicator movement is in a housing or "body tube", which, in this case, means the handle of the device.

According to Packaging World (September 2006, p. 98), a company called "HERA" has introduced into the market "Mascara Auto Magic—described as the world's first automated electronically rotating mascara. The electronic-motion, "coil-type," rubber-brush system is designed to make mascara application easier for consumers." Apparently, this is a rotating-type applicator having the source of applicator movement in the handle.

These are unlike the present invention where the source of vibration (i.e. motor) is located substantially close to the applicator head, not in the handle, such that the vibration source is immersed in the mascara container whenever the mascara applicator is immersed in the mascara container. None of the foregoing references appreciates the performance and manufacturing improvements offered by a vibrating mascara applicator that has the source of vibration located substantially close to the applicator head.

Vibrating devices having a source of vibration located toward to the "working end" of the device are known. Patents to the Gillette Company disclose vibrating safety razors having the source of vibration toward the distal end of the handle. (See U.S. Pat. No. 5,299,354, WO 2004/073936, WO 2004/073938, WO 2004/073940, WO2004/073941). Even though the source of vibration is toward the working end, it is still in the handle of the device. Furthermore, for obvious reasons a shaving razor and a dental flosser are wholly unsuitable for mascara application. U.S. Pat. No. 5,299,354 discloses a vibrating wet shave razor. The be effective for shaving, the frequency of the electric motor is disclosed as being 5000 to 6500 revolutions per minute. The amplitude of the vibrating blade that is effective for shaving is disclosed as 0.002 to 0.007 inches.

WO 2005/046508 discloses an electric toothbrush in which the source of brush movement is toward the distal end of the handle. Even though the source of vibration is toward the working end, it is still in the handle of the toothbrush. Furthermore, despite their superficial similarity to motorized mascara brushes, the typical electric toothbrush also has a number of significant differences with them. These differences make a toothbrush ineffective for performing many of the functions of a mascara brush, as discussed above. Generally, toothbrush bristles have different stiffness requirements than those of a mascara brush, owing to their different purposes and areas of use. Also, toothbrush bristles are generally longer, as much as two to five times longer than mascara brush bristles. The toothbrush bristles are located only on one side of the head as opposed to generally surrounding the head. A toothbrush does not have a working tip at the distal end of the head as do most mascara brushes. The envelope of the toothbrush may be a two dimensional plane, rather than a three dimensional surface. Toothbrush bristles are generally more densely packed than those of a mascara brush and they are usually all the same length, unlike most mascara brushes which have varied length bristles. Toothbrush bristles are generally supported by a relatively large, flat base that is located at the exterior of the bristle array as opposed to the center of the bristle array. Such a base cannot fit into a common mascara tube and if it could it would become covered with mascara making a mess and wasting a lot of mascara. Owing to their many differences, mascara brushes and toothbrushes are generally patentably distinct.

Application Habits. While there are many variations in the way mascara users apply the product, there is some consensus on the best methods for so doing. In "The Beauty Bible," (by Paula Begoun, 2nd ed., June 2002, Beginning Press, ISBN 1-877988-29-4), herein incorporated by reference in its entirety, the author recommends the following. "The traditional upper-lash application of rotating the mascara wand by round-brushing from the base of the lashes up to cover all the lashes around the entire eye is the most efficient, expedient method." The author further notes, "Apply mascara to the lower lashes by holding the wand perpendicular to the eye and parallel to the lashes (using the tip of the wand). This prevents you from getting mascara on the cheek. It also makes it easier to reach the lashes at both ends of the eye." Also, after applying the mascara in whatever manner, some women brush out the lashes with a separate brush or comb.

OBJECTIVES

A main object of the present invention is to provide an improved vibrating mascara applicator.

Another object of the present invention is to provide an improved vibrating mascara applicator that consumes less power.

Another object is to provide an improved vibrating mascara applicator that is more comfortable for the user.

Another object is to provide an improved vibrating mascara applicator, constructed with in-mold/over-molding technology.

Another object is to provide an improved vibrating mascara applicator of reduced circuit complexity.

Another object is to provide an improved vibrating mascara applicator with simple design for automated assembly.

Another object is to provide an improved vibrating mascara applicator with easier replacement of batteries.

The foregoing objectives and other benefits may be realized by an improved vibrating mascara applicator wherein the vibrational source is located substantially close to the applicator head, not in the handle. Other objects of the invention and the advantages of it may be clear from reading the description to follow.

SUMMARY

The present invention is an improved vibrating mascara applicator, wherein the source of vibration is located outside of the handle, substantially close to, or inside, the applicator head. The position of the vibration source is such that the vibration source will be located inside the mascara container, below the neck of the container, whenever the applicator is fully inserted into the container. This broad concept is applicable to an unlimited range of mascara applicator types, as well as to cosmetic and personal care applicators and grooming tools in general.

DETAILED DESCRIPTION

Throughout this specification, the terms "comprise," "comprises," "comprising" and the like shall consistently mean that a collection of objects is not limited to those objects specifically recited.

Throughout this specification the terms "oscillate" and "vibrate" are synonymous, and connote a back and forth component to the motion. Thus, for example, pure rotation is not vibration/oscillation.

For simplicity, the starting point for this discussion is a typical mascara brush applicator, as described above. However, in principle, with the benefit of this disclosure, a person of ordinary skill in the art can apply the teachings of this disclosure to virtually any type of mascara applicator. Therefore, the applicator head is not limited to being a bristle head and may be any other type of mascara applicator head, such as the disc array described above.

Figure 1:
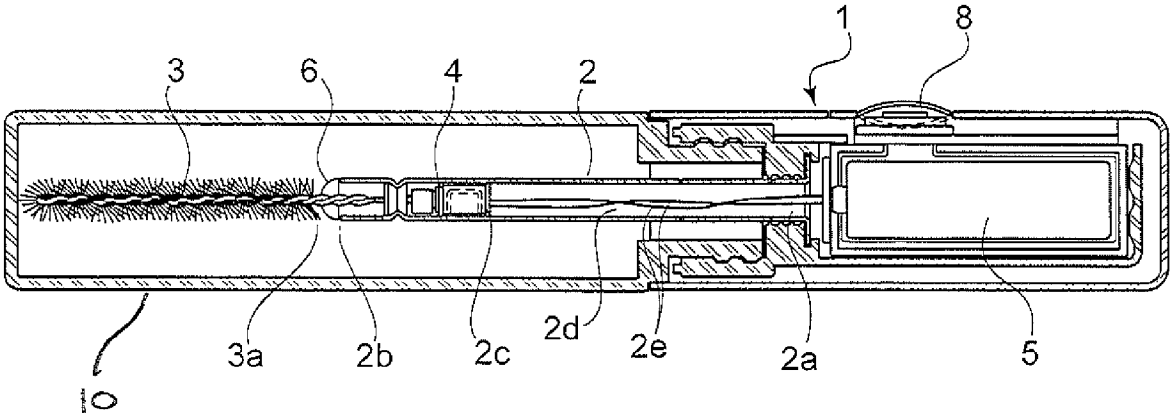
FIG. 1 is a cross section of one embodiment of the present invention.
Figure 3:
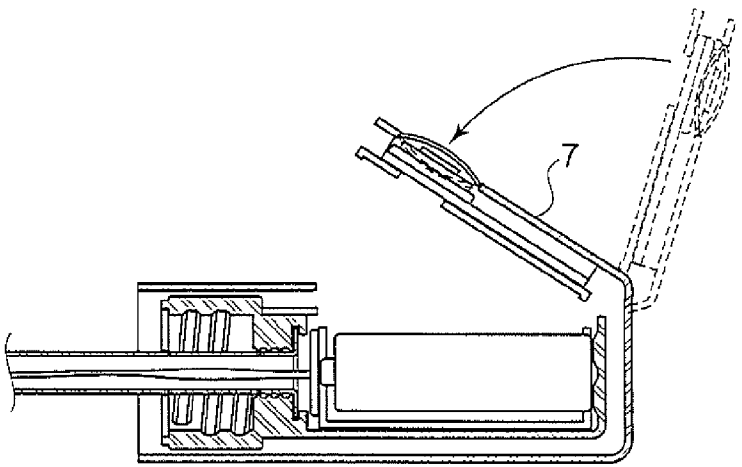
FIG. 3 is a cross sectional view showing access to the battery compartment.

With the above in mind, and referring to FIG. 1, a basic mascara applicator according to the present invention comprises a handle (1); a rod (2) attached at its proximal end to the handle, either directly or indirectly, and extending beyond the handle; an eyelash applicator head (3) attached to the distal end of the rod; and a source of vibration (4) that causes the applicator head to vibrate. The handle is equipped with screw threads or other means for attaching to a reservoir or container (10), and the reservoir or container is capable of receiving the applicator head and rod inside, as is commonly done in the art of mascara packaging. Here, "eyelash applicator head" means any configuration recognized in the cosmetics field, now or in the future, as being suitable for making up or grooming the eyelashes, the most common of these being a bristle brush head, others having been described above.

Source of Vibration

The source of vibration (or vibrating means) supplies one or more vibratory influences directly or indirectly to the eyelash applicator head (3). By "indirectly" it is meant that one or more vibratory influences are supplied to a portion of the applicator other than the bristle head and subsequently, one or more vibratory influences travels to the bristle head, arriving there with sufficient energy to be effective for the intended purpose. By "directly" it is meant that one or more vibratory influences are supplied to the bristle head without having to travel first through the other parts of the applicator, i.e. the handle or rod, etc.

Either way, the type of motion executed by the vibrating bristles is different from that of the rotating brushes and longitudinally reciprocating brushes described above. With those brushes, the entire bristle envelope rotates about the long axis of the rod and no flexing of the rod occurs. In the present invention, the bristle envelope may not rotate. Depending on the design of the brush and the location and parameters of the vibrating means, either each individual bristle flexes from its point of insertion in the core or the rod flexes in a direction essentially perpendicular to its length, or both. The flexing of the rod may be a simple lateral flexion or side-to-side motion or the tip of the applicator may trace out a curvilinear path, for example an ellipse. Of course, as the rod flexes, the bristles are carried along in this motion.

A preferred source of vibration is one or more DC motors (4). A simple DC motor as used in a preferred embodiment of the present invention comprises at least six parts. These are: the armature (or rotor), the commutator, brushes, an axle, a field magnet and electrical leads. The relationships and workings of these parts in a DC motor are well known. In order to generate a vibratory influence, the center of mass of the axle is offset from the longitudinal axis of the axle. That is, the axle is weighted more heavily on one side of the axis of rotation than the other. Thus, when the axle rotates, a vibration is produced which travels out of the motor and into the applicator head (3) (i.e. brush) of the mascara applicator. To this end, the axle may be fitted with an eccentric counterweight. Motors of this type may be found in pagers and cell phones that vibrate. In terms of size, "miniature motors" or "vibration motors" suitable for use in the present invention are commercially available from many sources. Optionally, a more sophisticated motor may be used. For example, a mascara applicator according to the present invention may comprise a motor that changes speeds, either stepwise or continuously at the discretion of the user.

The amplitude of the vibration produced by the motor is determined, at least in part, by the speed of the motor, the mass of the eccentric counterweight, its degree of offset from the longitudinal axis of the axle and the relative orientation of the motor axle and brush axis. The amplitude of vibration of the applicator head further depends on the geometry and connections of the materials through which the vibration must propagate from the motor to the applicator head. Most immediately, however, the amplitude of vibration of the applicator head (and the energy transferred by the vibration to the mascara), depends on the distance between the motor and the applicator head.

A distinguishing feature of the present invention is that the source of vibration is located substantially close to the applicator head, outside of the handle. Throughout the specification, including in the claims, "substantially close to the applicator head" means that when an applicator head is immersed in a mascara container, the vibrational source is necessarily located inside the container, preferably below the level of the neck. This includes locating the vibrational source in or on the rod of the applicator and/or in or on the applicator head itself. Generally, this excludes locating the vibrational source in the handle. It also excludes locating the vibrational source in any part of the applicator that is not inside the container when the applicator head is inside the container. An applicator according to the present invention represents both quantitative and qualitative improvements over an applicator according to U.S. Ser. No. 11/154,623 (Kress, et al) and U.S. 60/600,452 (Kress).

For example, because the source of vibration is immediately adjacent to the applicator head, the vibration is not significantly attenuated in traveling from the source to the applicator head. This is unlike other vibrating mascara devices, in which any vibration energy must travel a substantially farther distance, across various discontinuities and interfaces, before reaching the applicator head. The loss of energy along the way, may be substantial. Furthermore, when the source of vibration is located outside of the handle, the user's grip does not attenuate the energy that reaches the applicator head. In contrast, when the user grips a handle that houses a source of vibration, she is necessarily attenuating the vibration with her grip.

Therefore, an applicator according to the present invention is, generally, more efficient at transferring energy to the mascara product. Thus, in a given time, an applicator according to the present invention will have a substantially greater effect on the rheology of a mascara product. Put another way, to get a comparable result, an applicator according to the present invention consumes less energy.

There are additional benefits. For example, the source of vibration is significantly further from the handle than any of the prior art devices. Therefore, the vibration is attenuated in traveling from the source to the handle. The result is less vibrational energy being absorbed by a user's hand. This represents both an aesthetic and a performance benefit, because reduced vibration in the hand feels better and is less distracting to a user as she applies the mascara.

Furthermore, when the source of vibration is in the handle, the user's grip is expected to affect the pattern of vibration. It is expected that the pattern of vibration is affected differently by each user's grip. Thus, the grip introduces an element of uncertainty in the actual pattern of vibration. By locating the source of vibration outside of the handle, the effect of the grip on the pattern of vibration is reduced or eliminated. Therefore, a vibrating applicator having the source of vibration outside the handle, vibrates in a more predictable way.

In one embodiment (hereafter, the First Embodiment) of the present invention, the vibration source is a DC motor (4) that is secured inside the rod (2) of the mascara applicator, substantially close to, but not within, the applicator head (3) (see FIG. 1).

Figure 4:
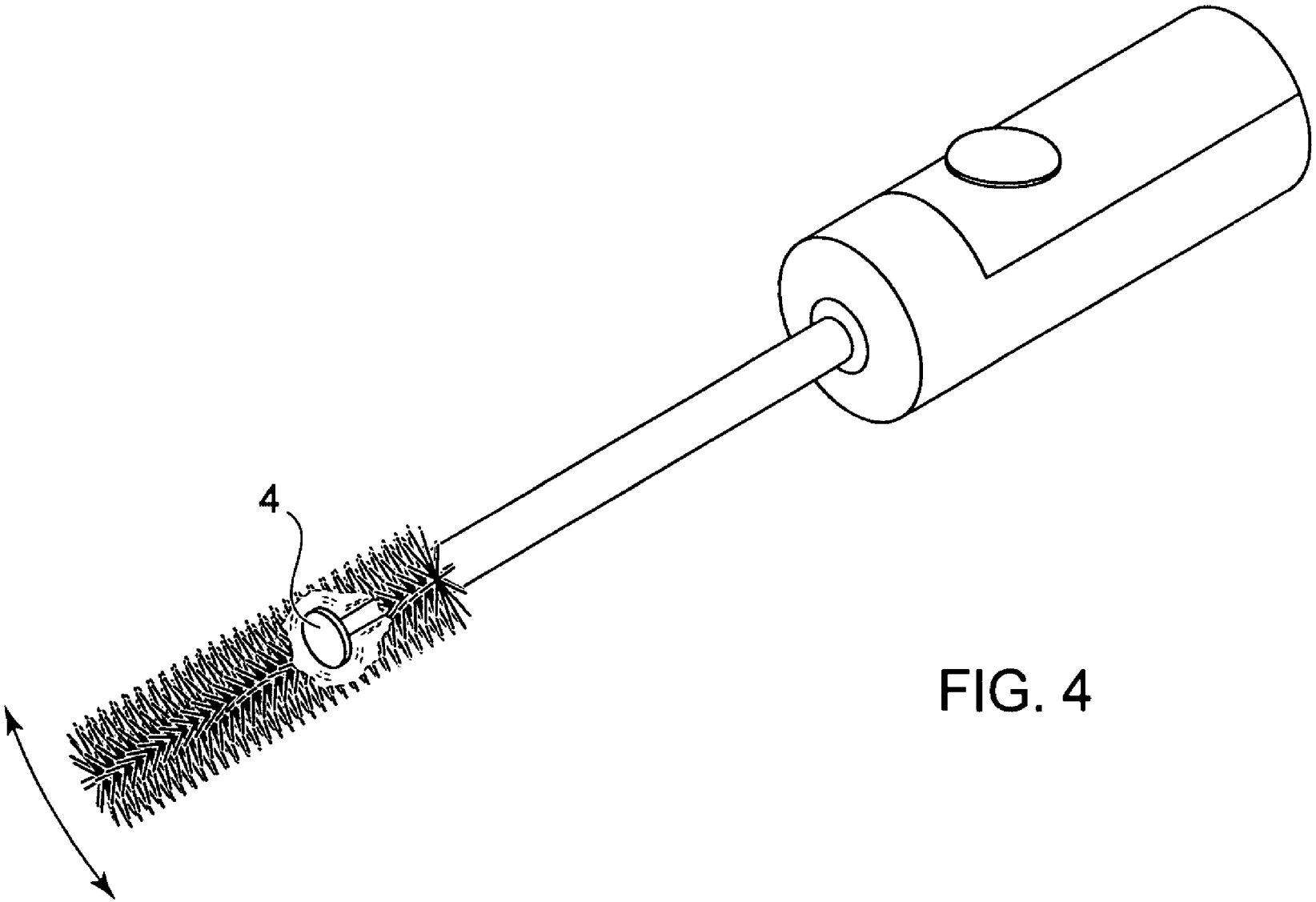
FIG. 4 is a cutaway showing the source of vibration located inside an applicator head.

In one embodiment (hereafter, the Second Embodiment) of the present invention, the vibration source (4') is secured inside an applicator head (3) of the mascara applicator (see FIG. 4).

While, at the time of writing, miniature DC motors represent a preferred source of vibration, electronic technology is advancing rapidly and, in the future, micro AC motors, piezoelectric motors, hybrid circuits or sources of vibration based on currently unfeasible technology may become preferred components.

The Rod

The rod (2) has a proximal end (2*a*) and a distal end (2*b*). The proximal end connects to a handle (1). The distal end connects to an applicator head (3). In the First Embodiment, the rod has a hollowed portion (2*c*) that accommodates the motor (4), such that the motor is free to operate. In the drawings, the hollowed portion is accessible through the distal end of the rod. Depending on the size of motor used, the rod diameter may be typical of those used in conventional mascara applicators. Of course, it is also possible to enlarge the rod diameter, as long as the rod can be inserted into the mascara container.

The motor (4) should be held securely while being allowed to function unhindered. Ideally, during operation, the overall position of the motor relative to the rod (2), should not change. That is, the motor should not be free to jiggle around in the hollowed portion. The rod and/or motor may be provided with some retention means that holds the motor in place, inside the hollowed portion of the rod. The hollowed portion may be sized to receive a portion of the motor in a friction fit. Or, a portion of the motor may be glued to a surface of the hollowed portion of the rod. Also, a portion of the rod distal to the motor may be narrower than the motor, such that the motor can be forced into the hollowed portion, but cannot back out on its own. Alternatively, it be advantageous to dispose the motor inside a motor housing. The purpose of the housing is to hold the motor securely while allowing it to function. The outside of the motor housing, which has no moving parts, may be secured to the inside of the rod more easily than the motor.

In the Second Embodiment, the vibration source (4') (i.e. motor) is not located in the rod and there is no need for a hollowed portion for the motor, in the rod. However, in either the First or Second Embodiment, the rod (2) facilitates electrical contact between the motor and power source (5) located near the handle. In general, conductors (2*e*) must pass from one end of the rod to the other and means for making an electrical contact at either end must be provided.

In the First Embodiment, one example of this would be a channel (2*d*) on the interior of the rod, between the proximal end (2*a*) and distal end (2*b*) of the rod. The channel at the proximal end of the rod may open up into a housing for the power source (5). The channel at the distal end of the rod may open up into the hollowed portion (2*c*) for the motor (4). The channel allows electronic components (2*e*) to be fed through the rod, from the power source to the motor and back again. The motor must be inserted into the hollowed portion, such that electrical contact is established between the electronic components in the channel and the motor. The electronic components may be simple metallic conductors or more sophisticated printed circuit elements, such as rigid or flexible printed circuit boards. The printed circuit elements may be attractive when more control than a simple On-Off switch, is desired.

In the Second Embodiment, the rod (2) facilitates electrical contact between the power source (5) and the vibration source (4') in much the same way as the First Embodiment, except here, the distal end (2*b*) of the rod is such that it allows the electronic elements (2*e*) to pass into the applicator head (3), where the motor is located. Again, the channel (2*d*) allows electronic components to be fed through the rod, from the power source to the motor and back.

The electrical conductors may be inserted into the rod after the rod is manufactured, or they may be in-molded with the rod at the time of manufacture. If in-molded, the ends of the electrical conductors should emerge from the rod at some points, to be connected to the rest of the circuit.

Electrical contact between the vibration source and the power source may be effected by any type of electronics suitable for use in the confines of the rod, and such means may be apparent to persons skilled in the electronic arts. Ideally, during operation, the overall position of the electronic components relative to the rod, should not change. For example, the motor should not be free to jiggle around inside the rod. Considering the vibrational forces to which the electronic components are subjected, securing the components will reduce the risk of a break in the circuit. Depending on the type of electronics used, the rod and/or electronic components may be provided with features to support and/or secure the electronic components. Such features include snap-fitments, friction fitments, in-molding, gluing, welding, etc.

In general, the efficiency and predictability of the vibration supplied by the motor decreases with increasing number of interfaces through which the vibration must pass as it makes its way to the brush head. Vibrational energy is lost at connections between materials and gaps in the surfaces that transmit the vibration. Also, a multitude of interfaces and gaps alters the qualitative aspects of the vibrational signal in unpredictable ways, which will vary from applicator to applicator. An improved vibrating mascara is achieved by keeping the number of interfaces to a minimum and by providing an adequate amount of solid surface between the motor and the brush head. Thus, in the most preferred First Embodiment of the present invention, a motor located in a motor housing, is in-molded or over-molded within the rod or applicator head. By molding the motor into the applicator head, the greatest amount of solid contact and least amount of gap is achieved. Thus, an applicator rod with in-molded or over-molded motor is energetically superior and more predictable than an applicator rod with motor inserted into a hollowed space. A further improvement is achieved if the applicator head is integrally molded with the rod.

The Applicator Head

The applicator head (3) depends from the distal end (2*b*) of the rod (2). A proximal end of the applicator head is connected to the distal end of the rod.

In the First Embodiment (vibration source in rod), the applicator head (3) may be any configuration recognized in the cosmetics field, now or in the future, as being suitable for making up or grooming the eyelashes, the most common of these being a bristle brush head, others having been described above.

When the motor (4) is mounted into the rod (2), through an opening in the distal end of the rod, then it will be necessary to mount the motor into the rod prior to securing the applicator head (3) onto the rod. Once the motor is mounted into the rod, taking care to complete the electrical connections between the motor and the conductor elements in the rod, then the applicator head can be attached to the distal end of the rod, closing off the access to the hollowed portion (2*c*) of the rod. The distal end of the rod and the proximal end of the applicator head may be joined by any suitable means, for example, snap-fit, friction fit, screw threaded engagement, lug-type screw engagement, welded or glued connection or integral molding. Some of these connections are temporary, which allows the applicator head and rod to be separable.

One or more additional components may intervene between the applicator head and the rod to effect the connection. For example, if the applicator head is a set of bristles wound in a twisted wire core, as commonly done in the art, then the twisted wire core and distal end of the rod may require one or more intervening connectors. For example, FIG. 1 shows a plastic rod tip (6). The rod tip secures into the opening in the distal end of the rod, while one end of the twisted wire core (3*a*) is inserted into a hole in the plastic tip.

In the Second Embodiment the vibration source (4') is within the applicator head. Here and throughout, "within the applicator head" means within the applicator envelope, whether that envelope is a bristle envelope as defined above or as may be analogously defined for other types of applicators. For example, if the applicator head comprises a substrate with a foam flocking, the applicator envelope is the outer surface of the foam, and the source of vibration is located within that envelope.

Regardless of the type of applicator, the applicator head comprises a space within the applicator envelope. The space is suitable for receiving a motor or other vibration source (4', see FIG. 4). The motor may be mounted into the applicator head through an opening in the proximal end of the applicator head, and may be secured in any convenient fashion, similar to that described for the First Embodiment.

When the motor is mounted into the applicator head through the proximal end of the applicator head, then it may be necessary to mount the motor into the applicator head prior to securing the applicator head onto the rod. Once the motor is mounted into the applicator head, the proximal end of the applicator head can be attached to the distal end of the rod, as described above, taking care to complete the electrical connections between the vibration source and the conductor elements coming from and going to the rod.

When the applicator head or a portion thereof, is of the molded type, then, as above, it is most preferred if the motor is in-molded or overmolded into the applicator head. In this most preferred Second Embodiment of the invention, the motor may need to be provided in a motor housing prior to in-molding or overmolding. By molding the motor into the applicator head, the greatest amount of solid contact and least amount of gap is achieved. Thus, an applicator head with in-molded or overmolded motor is energetically superior and more predictable than an applicator head with motor that is simply inserted into a hollowed space.

The benefits of in-molding and overmolding are not limited to energy efficiency of the vibrating device. There are also manufacturing advantages. In-molding and overmolding reduce assembly complexity and improve component integrity. A labor savings may be expected when in-molding or overmolding the rod and motor, and a cost savings is anticipated.

The Power Supply

The present invention further comprises a power supply that supplies the source of vibration with power. One example of this may be a DC power supply (5), located in the handle (1) and electrically connected to the motor (4 or 4') to supply the motor with power. Conducting terminals of the sort generally encountered in electronics are contemplated and may be associated with the power source and motor. In a preferred embodiment, the DC power supply is one or more batteries that, fit inside the handle of the applicator. Common household batteries, such as those used in flashlights and smoke detectors, selected to provide the motor with the proper current and voltage, are preferred. These typically include what are known as AA, AAA, C, D and 9 volt batteries. Other batteries that may be appropriate are those commonly found in cell phones, hearing aides, wrist watches and 35 mm cameras. The present invention is not limited by the type of chemistry used in the battery. Non-limiting examples of battery chemistry include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries.

Other sources of DC current include solar based power, like solar cell technology, as found in many handheld devices, for example calculators and cell phones. According to this embodiment, one or more light collecting portions are located where sunlight or artificial light may shine on it. For example, the light collecting portions may be located on the outside surface of the handle, parallel to the axis of the handle. When light impinges the light collecting portions, the light energy is converted to electrical current for supplying the motor, via well known light cell technology. Optionally, a storage cell may be provided to store any unused electrical energy created by the photo cell, which may be later used to supply the motor, as for example when the lighting is too dim to create an adequate photo current for the motor.

While, at the time of writing, miniature DC motors represent a preferred source of vibration, and therefore DC components represent a preferred source of electric power, nothing in this specification prohibits the use of power sources based on currently unfeasible technology, that may emerge in the future.

The Handle and Switch

The handle (1) is the part that is normally grasped by a user to manipulate the applicator during mascara application. In a manner conventional in the art, the handle may receive into itself, the proximal end (2*a*) of the rod. Also, the handle serves as a closure for the mascara container, in a manner conventional in the art. To do this, the handle may comprises an inner closure with cooperating screw threads and an overshell which in which the inner closure is disposed. The overshell comprises a housing for the power supply. Any electrical contact and leads that may be needed to move electric power from the power supply to the conducting elements of the rod, can be provided and secured inside the power supply housing.

Figure 2:
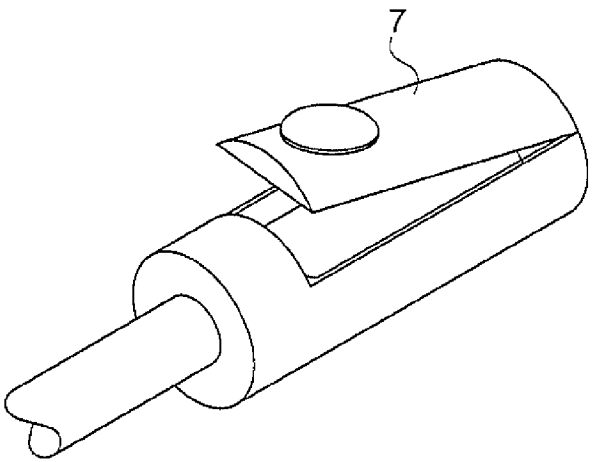
FIG. 2 is a perspective view of one embodiment of the present invention, showing the access to the battery compartment.

Preferably, the handle (1) comprises access to the power supply, so that a depleted power supply can be replaced. For example, a side wall, or portion thereof, of the handle may have a hinged door (7, see FIG. 2) that opens to provide access to one or more batteries. Alternatively, the proximal end of the handle may unscrew from the handle to create access to the interior of the handle and one or more batteries.

An applicator according to the present invention, further comprises at least one means for turning the motor on and off. Generally, the on/off means is capable of alternately interrupting and re-establishing the flow of electricity between the motor and power source. In a preferred embodiment, at least one of the on/off means is one or more switches (8) accessible from the outside the applicator that can be engaged, either directly or indirectly, by a finger of the user. Preferably, the on-off means is located on the handle (1). This type of on-off means will be referred to as "manual" in the specification. The switch, DC power supply and motor are electrically connected to form a closed circuit, in any manner well known in the electrical arts. Generally, a switch may comprise two electric leads. The details of such switches are well known in the electrical arts and there are many suitable types. Some non-limiting examples include: toggle switches, rocker switches, sliders, buttons, rotating knobs, touch activation surfaces, magnetic switches and light activated switches. Also, multi-position switches or slider switches may be useful if the motor is capable of varying speeds. Various types of manual and automatic switches are described in U.S. Ser. No. 11/154,623 (Kress, et al).

The handle (1) of the applicator may advantageously comprise a means of communicating to the user, what is the direction of oscillation of the brush head. Because the direction of the brush head oscillation it may not be easily discernible, some means for informing the user may be provided. One means comprises indicia (inscribed, etched, printed, etc.) located on the handle that indicates to the user the direction of motion of the brush head. An alternate means may be to provide a contoured surface on the handle, such as a molded grip, that directs the user to grasp the applicator in such a way that the brush head motion will be horizontal when the applicator is raised to the eye. Other such means will be obvious to a person of ordinary skill in the art. Optionally, the handle of the applicator may be provided with a grip that absorbs some or substantially all of the vibration, such that a user does not perceive the vibration in her hand. This may be desirable to the extent that any vibration felt in the hand of a user is unpleasant or a distraction during application. A soft rubber grip or gel-filled grip are examples grips that are suitable for this purpose.

Optional Features

Preferably, portions of an applicator according to the present invention are reusable. The vibration source is likely to be the most expensive part of the applicator, so its reusability is a real advantage. The vibration source may be part of the applicator head or the rod. However, even when the vibration source is in the applicator head, the handle and rod also comprise electronic elements making their reuse advantageous.

Some of the following options would negate the use of an integral applicator head and rod, the advantages of which were discussed above, but the options are contemplated by the present invention.

To effect reusability of either of these, it may be preferable if the applicator head and rod are separable. The separable feature may be effected by any suitable means that renders one or more portions of the applicator reusable. For example, the applicator head may be detachably attached to the rod. A detachable attachment can be obtained by friction fitting or snap fitting part of the applicator head into part of the rod or vice versa. Alternatively, these parts may be joined by cooperating screw threads or lugs. Many suitable configurations will be apparent to those skilled in the art.

Considering the First Embodiment (vibration source in the rod), it is a benefit to be able to detach and replace the applicator head with a new applicator head. By making the applicator head detachable, the vibration means (for example, electric motor) can be reused indefinitely, with the same type of mascara or different mascara and with the same type of brush head or different brush head. The removed head may be disposed of or saved for later re-use.

In the Second Embodiment (vibration source in the applicator head), complete separation of the rod and applicator head requires disconnecting the electrical connection between the vibration source and the electronic elements in the rod. Thus, in the Second embodiment, it is preferable if the electrical connection between the vibration source and the electronic elements in the rod are detachable and reusable, such as snap-fitted, mated electric leads. Once separated, either portion may be reused, replaced and discarded or saved for later reuse. Also, in the Second Embodiment, it may be desirable to re-use either or both of the handle-rod assembly and the applicator head. Both comprise electronic componentry that may not be economical to dispose.

Parameters

A useful range of vibrational frequency is expected to be from about 10 to about 1000 cycles per second. However, miniature motors seem to be readily commercially available up to about 300 cycles per second. Because it may be difficult at present to manufacture or obtain miniature motors beyond about 300 cycles per second, a range of 10 to 300 cycles per second is preferred, 30 to 100 most preferred.

A useful range of vibrational amplitude is about one sixty-fourth (0.016) to about one quarter (0.250) of an inch. Beyond this, the motion of the brush may be distracting to the user and the product reservoir may be too small to allow a larger movement. Less than this may be difficult to achieve in the simple design set forth here. One thirty-second to one eighth of an inch is preferred and about one-sixteenth of an inch is most preferred. An amplitude of one sixteenth is sufficient to shear the product while not being too distracting to the user.

These useful ranges of frequency and amplitude are significantly different from those disclosed in known personal care vibrational devices, such as, for example U.S. Pat. No. 5,299,354 for the oscillating shaver, discussed above. For reasons not apparent in the '354 patent, an oscillating blade drawn across the skin has the disclosed amplitude of 0.002 to 0.007 inches, compared to 0.016 to 0.250 inches of the present invention. Also, the motor frequency of the oscillating shaver is disclosed as being 5000 to 6500 rpm, compared to a preferred range of 600 to 18000 for the present invention. Of course, in the present invention the vibrational values of the oscillating brush are adapted to alter the viscosity of a mascara. In contrast, the vibrational values of the oscillating shaver are presumably selected to optimize raising the facial hair.

The following unambiguous definition of "substantially close to the applicator head" should be borne in mind when reading the claims. "Substantially close to the applicator head" means that when an applicator head (3) is immersed in a mascara container, the vibrational source (4 or 4') is necessarily located inside the container, preferably below the neck of the container, where the energy of vibration may be more efficiently transferred to the product. This includes locating the vibrational source in or on the rod of the applicator and/or in or on the applicator head itself. Generally, this excludes locating the vibrational source in the handle (1). It also excludes locating the vibrational source in any part of the applicator that is not inside the container when the applicator head is inside the container.

What is claimed is:

1. A package for a vibrating mascara applicator comprising:

a handle that is equipped with means for attaching to the container;

a rod attached at its proximal end to the handle;

an eyelash applicator head attached to the distal end of the rod;

a container having a neck, the container being capable of receiving into itself, the applicator head and rod; and a vibration source that is located substantially close to the applicator head, such that when the applicator head is inside the container, the vibration source is necessarily located inside the container, and such that when the applicator head is vibrating, the rod flexes in a direction perpendicular to the length of the rod; and wherein the amplitude of the applicator head vibration is about one sixty-fourth to about one quarter of an inch.

2. The applicator of claim 1 wherein the vibration source is a DC motor subassembly having an axle, the center of mass of which is offset from its longitudinal axis.

3. The applicator of claim 2 further comprising a DC power supply electrically connected to the motor.

4. The applicator of claim 3 wherein the DC power supply is one or more batteries located in the handle of the applicator.

5. An applicator according to claim 2 further comprising a switch for turning the motor on and off.

6. The mascara applicator of claim 1 wherein the amplitude of applicator head vibration is about one thirty-second to about one eighth of an inch.

7. The mascara applicator of claim 6 wherein the amplitude of applicator head vibration is about one sixteenth of an inch.

8. The mascara applicator of claim 1 wherein the frequency of applicator head vibration is about 10 to about 1000 cycles per second.

9. The mascara applicator of claim 8 wherein the frequency of applicator head vibration is about 10 to about 300 cycles per second.

10. The mascara applicator of claim 9 wherein the frequency of applicator head vibration is about 30 to 100 cycles per second.

11. The mascara applicator of claim 1 wherein the rod and applicator head are separable.

12. The vibrating applicator of claim 1 wherein the vibration source is located in the rod.

13. The mascara applicator of claim 12 wherein the rod is reusable.

14. The vibrating applicator of claim 1 wherein the vibration source is located in the applicator head.

15. The mascara applicator of claim 14 wherein the applicator head is reusable.

16. The mascara applicator of claim 1 wherein the vibration source is in-molded or overmolded with the rod or applicator head.

* * * * *